US008142161B2

(12) United States Patent
Prince et al.

(10) Patent No.: US 8,142,161 B2
(45) Date of Patent: Mar. 27, 2012

(54) REPLACEABLE STAKING INSERT

(75) Inventors: Stephen Robert Prince, Simpsonville, SC (US); Stephen Paul Wassynger, Simpsonville, SC (US); Thomas R. Tipton, Greer, SC (US); Tushar S. Desai, Bangalore (IN); Michael E. Friedman, Simpsonville, SC (US); Christopher Robert Kelly, Easley, SC (US); James Purdue Masso, Chesterfield, VA (US); Paul L. Kalmar, Zirconia, NC (US)

(73) Assignee: General Electric Company, Schenectady, NY (US)

( * ) Notice: Subject to any disclaimer, the term of this patent is extended or adjusted under 35 U.S.C. 154(b) by 1223 days.

(21) Appl. No.: 11/858,186

(22) Filed: Sep. 20, 2007

(65) Prior Publication Data

US 2009/0077795 A1 Mar. 26, 2009

(51) Int. Cl.
*F01D 5/32* (2006.01)

(52) U.S. Cl. ..... 416/221

(58) Field of Classification Search ..... 416/220 R, 416/221

See application file for complete search history.

(56) References Cited

U.S. PATENT DOCUMENTS

| | | | | |
|---|---|---|---|---|
| 2,753,149 | A * | 7/1956 | Kurti | 416/216 |
| 5,727,927 | A * | 3/1998 | Luxenburger | 416/220 R |
| 5,749,706 | A * | 5/1998 | Maar | 416/220 R |
| 6,390,738 | B1 * | 5/2002 | Fridman | 408/103 |
| 6,582,195 | B2 | 6/2003 | Davidson | |
| 6,837,686 | B2 * | 1/2005 | Di Paola et al. | 416/220 R |
| 2002/0029653 | A1 | 3/2002 | Knorowski et al. | |
| 2002/0085917 | A1 * | 7/2002 | Roberts et al. | 416/220 R |

FOREIGN PATENT DOCUMENTS

JP 59113207 A * 6/1984

* cited by examiner

*Primary Examiner* — Edward Look
*Assistant Examiner* — Aaron R Eastman
(74) *Attorney, Agent, or Firm* — Sutherland Asbill & Brennan LLP

(57) ABSTRACT

A rotating assembly. The rotating assembly may include a wheel, a slot positioned about the wheel with the slot having a staking recess positioned therein, a wheel attachment positioned within the slot, and a staking insert positioned within the staking recess. The staking recess axially retains the staking insert and the wheel attachment radially retains the staking insert.

19 Claims, 3 Drawing Sheets

REPLACEABLE STAKING INSERT

TECHNICAL FIELD

The present application relates generally to a replaceable staking insert for the retention of a wheel attachment and more particularly relates to a replaceable staking insert for a blade mounted on a compressor rotor or other type of rotating turbine component.

BACKGROUND OF THE INVENTION

Gas turbine systems generally include a compressor rotor having a number of stages. Air flowing into the compressor is compressed at each stage. Each stage includes a number of rotor buckets or blades mounted to a rim of a rotor wheel or a disk in a spaced relationship. A typical compressor rotor may have dozens of rotor blades mounted thereon.

Generally described, each blade may have a dovetailed portion that interlocks with a dovetail region of the rim to secure the blade to the rotor. The blade dovetails may be secured to the rotor via a process called "staking". Specifically, the rotor blade is placed within the rim slot and then "staked" into place by deforming the metal material around the blade dovetail with a tool similar to a nail punch. This process is then repeated for each rotor blade for each rotor assembly stage. Staking provides an economical and mechanically secured means of securing a blade or other attachment to the rotor or other type of wheel slot.

In an inspection or an overhaul process, the rotor blades may be removed from the rotor wheel and the original "stakes" may be ground out. There are a finite number of attachments due to a limited number of viable staking locations about the rotor wheel. As such, the rotor wheel generally must be replaced once these staking locations have been consumed even if the rotor wheel is otherwise still in operational condition.

There is a desire therefore for improved methods and devices for securing a blade or other type of wheel attachment to a rotor or other type of wheel without destroying the rotor or the wheel or limiting its part life. These improved methods and devices should provide for simple but secure attachment of the blade or other component to the wheel in a fast and efficient manner.

SUMMARY OF THE INVENTION

The present application thus describes a rotating assembly. The rotating assembly may include a wheel, a slot positioned about the wheel with the slot having a staking recess positioned therein, a wheel attachment positioned within the slot, and a staking insert positioned within the staking recess. The staking recess axially retains the staking insert and the wheel attachment radially retains the staking insert.

The application further describes a rotor assembly. The rotor assembly may include a rotor, a number of axial slots positioned about a rim of the rotor with the axial slots each having one or more staking recesses positioned therein, a blade positioned within each of the axial slots, and a staking insert positioned within each of the staking recesses.

The application further describes a staking tool assembly for use about a wheel with rim having a number of axial slots. The staking tool assembly may include a staking tool and a staking tool guide positioned axially about the rim and the axial slots of the wheel.

These and other features of the present application will become apparent to one of ordinary skill in the art upon review of the following detailed description when taken in conjunction with the several drawings and the appended claims.

DETAILED DESCRIPTION

Figure 1:
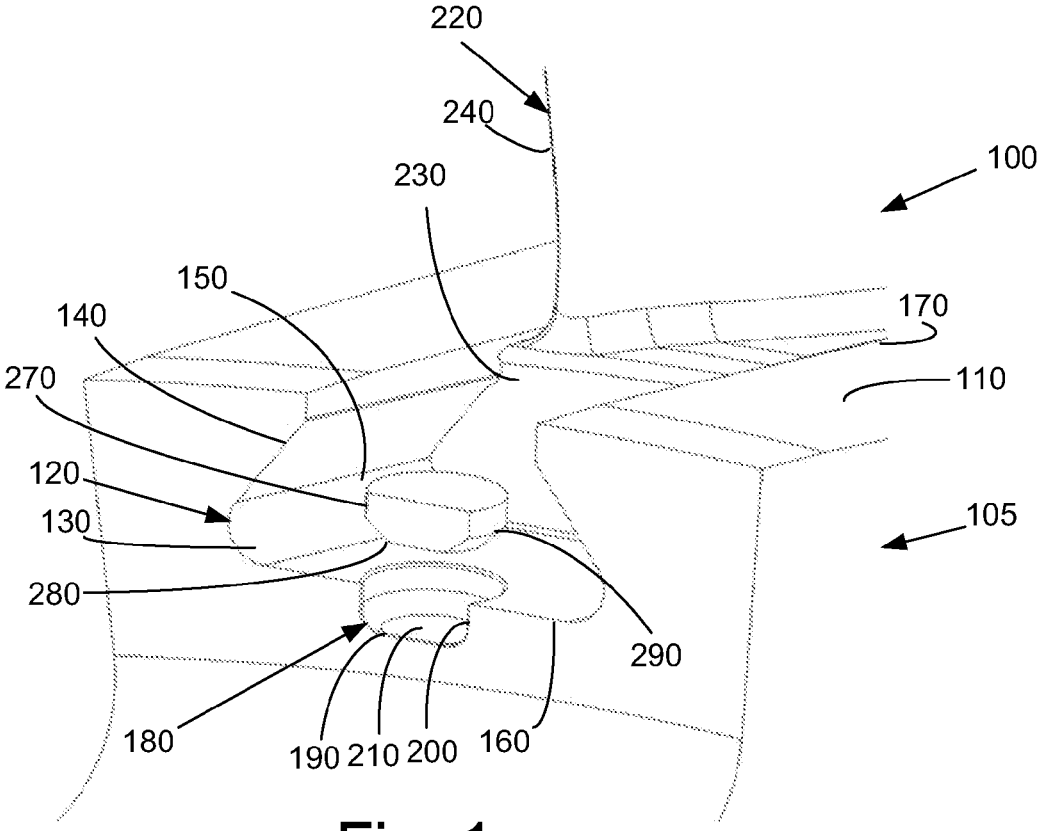
FIG. 1 is a perspective view of a blade being positioned within a rotor slot with a replaceable staking insert as is described herein.

Referring now to the drawings, in which like numerals refer to like elements throughout the several views, FIG. 1 shows a portion of a rotor assembly 100 as is described herein. The rotor assembly 100 includes a wheel or a rotor 105. A rim 110 of the rotor 105 may have a number of axial slots 120 formed therein. As described above, the axial slots 120 may have a substantial dovetail-like shape with a base 130, a pair of concave sidewall 140, and an upper opening 150. Other shapes may be used herein. Each axial slot 120 also has a first end 160 and a second end 170. The rotor 105 may have any number of axial slots 120 positioned about the rim 110.

Each end 160, 170 of the axial slot 120 may have an insert recess 180 formed therein. The insert recess 180 may include an insert base 190 that has a stepped down shape from the base 130 of the axial slot 120. The insert recess 180 also may have a pair of concave insert sidewalls 200 that define an axial opening 210. Other shapes may be used herein. The shape and dimensions of the insert recess 180 may vary with the geometry of the axial slot 120 and the rotor assembly 100 as a whole.

The rotor assembly 100 also includes a number of rotor buckets or blades 220. Any number of blades 220 may be used herein. Each axial slot 120 may have a blade 220 mounted therein. Each blade 220 may include a root 230 with an airfoil 240 extending therefrom. The root 230 may have a substantial dovetail-like shape that conforms to the dovetail-like shape of the axial slot 120. Specifically, the root 230 may include a base 250 and a pair of convex sidewall 260. The root 230 may extend the length of the axial slot 120 from the first end 160 to the second end 170 of the base 130 or the root 230 may extend for a portion of the length and one or more spacers (not shown) also may be used to fill the length of the axial slot 120.

The rotor assembly 100 further may include a staking insert 270. The staking insert 270 may be inserted in each of the insert recesses 180 of the axial slots 120. The staking insert 270 may be sized to cooperate with the insert recess 180 and may have a staking insert base 280 and a pair of convex sidewalls 290. Other shapes may be used herein. The staking insert 270 may be made out of alloy steel, nickel, or other types of substantially heat resistant and/or corrosion resistant materials. The staking insert 270 may be axially retained within the sidewalls 200 of the insert recess 180. Other types of complementary shapes and retaining means may be used herein.

In use, the staking inserts 270 may be inserted within the insert recesses 180 of the axial slots 120. Each axial slot 120 may have two (2) insert recesses 180 such that two (2) staking inserts 270 may be used for each blade 220. As described above, the staking insert 270 may be retained axially via the shape of the insert recess 180. A blade 220 then may be slid into each axial slot 120. The root 230 of the blade 220 retains the staking insert 270 radially.

Figure 2:
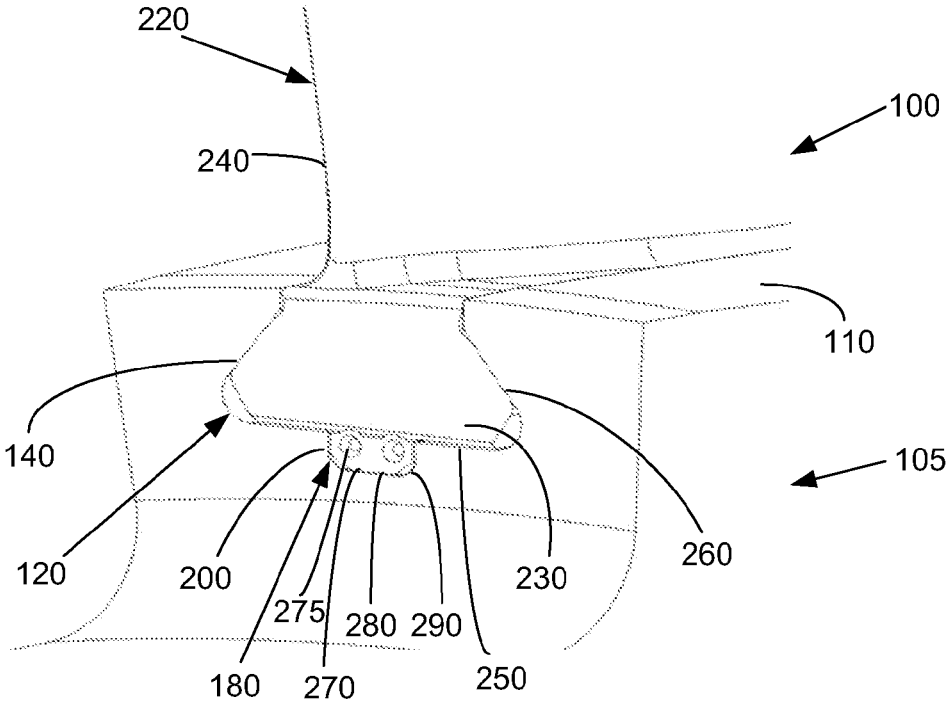
FIG. 2 is a perspective view of the completed assembly of FIG. 1.

As is shown in FIG. 2, after loose assembly of the inserts 270 and the roots 230 of the blades 220, the inserts 270 may be staked to retain axially the inserts 270 and the blades 220 to the rotor 105. In this example, two (2) staking indents 275 are formed therein. The blades 220 are thus mechanically attached and secured within the axial slots 120 of the rotor 105. Staking of the rotor 105 itself thus is not required. When the blade 220 needs replacing, a replacement staking insert 270 may be positioned within the insert recess 180 and restaked.

Figure 3:
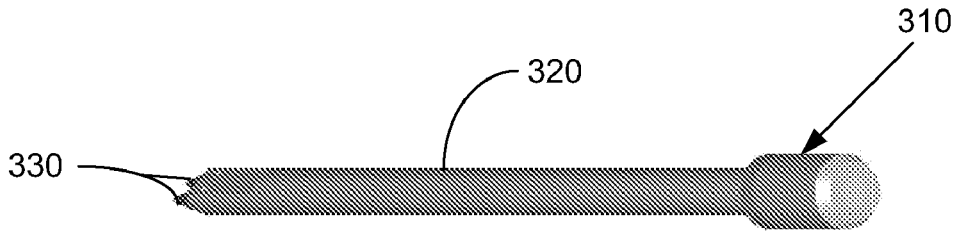
FIG. 3 is a perspective view of a staking tool as may be used herein.
Figure 4:
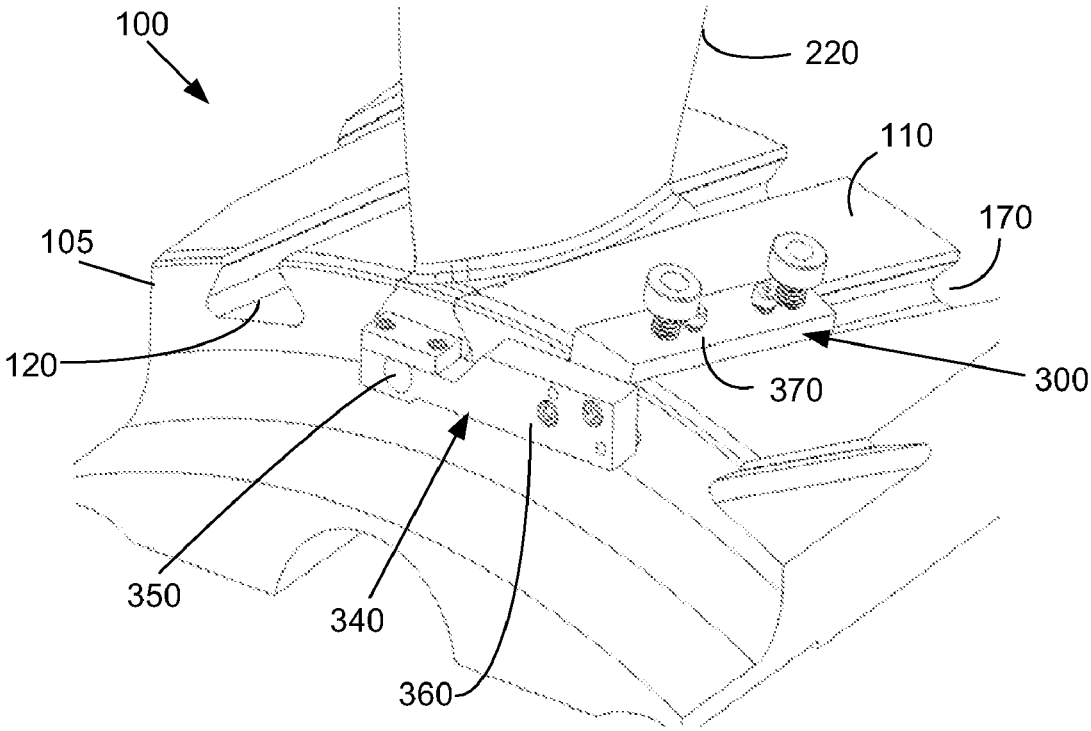
FIG. 4 is a perspective view of a staking tool assembly as is described herein.
Figure 5:
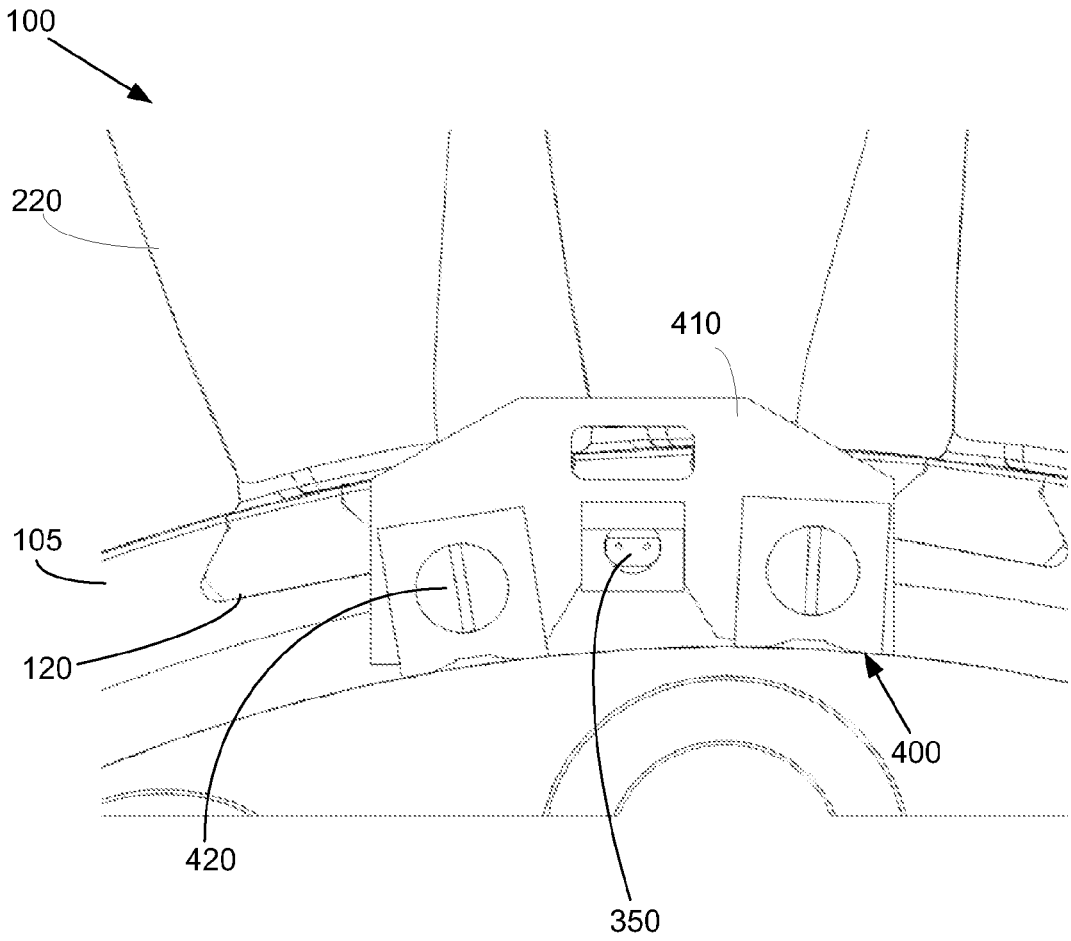
FIG. 5 is a perspective view of an alternative embodiment of a staking tool assembly as is described herein.

FIGS. 3-5 show an example of a staking tool assembly 300 and a staking tool 310. Generally described, the staking tool 310 includes an elongated shank 320 with two staking cones 330 on one end thereof. The staking cones 330 may be sized according to the size of the intended staking insert 270. Other configurations may be used herein.

The staking tool assembly 300 may include a staking tool guide 340. As is shown in FIG. 4, the staking tool guide 340 may include a staking tool aperture 350 that is sized according to the size of the staking tool 310 and the staking insert 270. The staking tool aperture 350 may be positioned within a member 360. The member 360 may be an elongated arm or other type of elongated member. The member 360 may be positioned about the insert recess 180 on the axial side of the rim 110 of the rotor 105. The staking tool aperture 350 and the member 360 may be supported by a base 370. The base 370 may be sized so as to fit within an adjacent axial slot 120. Once positioned therein, the base 370 may be secured by a number of pins or similar devices. The member 360 may be maneuverable about the base 370 so as to provide proper positioning about the insert 270.

The base 370 also may be used to position other types of equipment about the axial slot 120 or otherwise. For example, a drilling/milling apparatus may be mounted thereon to provide for machining of the axial slot 120 or otherwise. In this case, multiple bases 370 may be used such that both adjoining axial slots 120 may be used. Other types of equipment may be mounted herein.

FIG. 5 shows an alternative embodiment of a staking tool guide 400. In this embodiment, the staking tool guide 400 includes the staking tool aperture 350 positioned within a member 360 or a similar type of structure. In this embodiment, the staking tool guide 400 includes a magnetic base 410. The magnetic base 410 may have a number of magnets 420 therein so as to attach the staking tool guide 400 about the insert 270. The staking tool guide 400 of this embodiment may be used on the last axial slot 120 of the rotor 105 once all of the blades 220 have been inserted therein such that the base 370 cannot be used.

The use of the staking tool guides 340, 400 thus provide for the proper location of the staking tool 310 for controlled staking locations and consistently reproducible results. The staking inserts 270 may be quickly inserted and staked for efficient construction or repair.

Although the use of the rotor assembly 100 has been described herein with the use of the rotor 105, the present invention may be applicable to any type of rotating assembly. Other potential applications include rotating buckets of gas turbines, rotating buckets/blades of steam turbines, or the retention of any device that is mechanically attached to a rotating wheel or disk with an axial slot or dovetail arrangement.

It should be apparent that the foregoing relates only to the preferred embodiments of the present application and that numerous changes and modifications may be made herein by one of ordinary skill in the art without departing from the general spirit and scope of the invention as defined by the following claims and the equivalents thereof.

We claim:

1. A rotating assembly, comprising:
a wheel;
a slot positioned about the wheel;
the slot comprising a staking recess positioned therein;
a wheel attachment positioned within the slot;
a staking insert positioned within the staking recess; and
one or more staking indents formed on the staking insert for securing the wheel attachment within the slot, wherein the one or more staking indents are formed on the staking insert after the staking insert is positioned within the staking recess.

2. The rotating assembly of claim 1, wherein the wheel comprises a rotor and the wheel attachment comprises a blade.

3. The rotating assembly of claim 1, comprising a plurality of slots and a plurality of wheel attachments.

4. The rotating assembly of claim 1, wherein the slot comprises one or more staking recesses and one or more staking inserts are positioned therein.

5. The rotating assembly of claim 1, wherein the slot comprises a substantial dovetail-like shape and wherein the wheel attachment comprises a complimentary shape.

6. The rotating assembly of claim 1, wherein the staking recess comprises a base and a pair of sidewalls and wherein the pair of sidewalls axially retains the staking insert therein.

7. The rotating assembly of claim 1, wherein the wheel attachment radially retains the staking insert within the staking recess.

8. The rotating assembly of claim 1, wherein the staking insert comprises alloy steel, nickel, or other types of substantially heat resistant or corrosion resistant materials.

9. A rotor assembly, comprising:
a rotor;
a plurality of axial slots positioned about a rim of the rotor;
the plurality of axial slots each comprising one or more staking recesses positioned therein;
a blade positioned within each of the plurality of axial slots;
a staking insert positioned within each of the one or more staking recesses; and
one or more staking indents formed on the staking insert for securing the blade within the plurality of axial slots, wherein the one or more staking indents are formed on the staking inserts after the staking inserts are positioned within the one or more staking recesses.

10. The rotor assembly of claim 9, wherein each of the plurality of axial slots comprises a substantial dovetail-like shape and wherein the blade comprises a complimentary shape.

11. The rotor assembly of claim 9, wherein each of the one or more staking recesses comprises a base and a pair of sidewalls and wherein the pair of sidewalls axially retains the staking insert therein.

12. The rotor assembly of claim 9, wherein the blade radially retains the staking insert within the staking recess.

13. The rotor assembly of claim 9, wherein the staking insert comprises alloy steel, nickel, or other types of substantially heat resistant or corrosion resistant materials.

14. A staking tool assembly for use about a wheel with a rim having a number of axial slots, comprising:
a staking tool; and a staking tool guide comprising a base for mounting the staking tool guide to the wheel, wherein the staking tool guide is positioned axially about the rim and the axial slots of the wheel.

15. The staking tool assembly of claim 14, wherein the staking tool comprises one or more staking cones positioned thereon.

16. The staking tool assembly of claim 14, wherein staking tool guide comprises a staking tool aperture positioned within a member and wherein the staking tool aperture is sized to accommodate the staking tool.

17. The staking tool assembly of claim 14, wherein the base is sized to be positioned within one of the number of axial slots.

18. The staking tool assembly of claim 14, wherein the base comprises a magnetic base.

19. The staking tool assembly of claim 14, wherein the staking tool guide comprises a plurality of bases.

* * * * *